US005259331A

United States Patent [19]

Hagan

[11] Patent Number: 5,259,331

[45] Date of Patent: Nov. 9, 1993

[54] MOTOR POD FOR PONTOON BOAT

[75] Inventor: Lyle A. Hagan, Lebanon, Mo.

[73] Assignee: Outboard Marine Corporation, Waukegan, Ill.

[21] Appl. No.: 897,328

[22] Filed: Jun. 11, 1992

[51] Int. Cl.[5] ..... B63B 1/18

[52] U.S. Cl. ..... 114/61; 440/66

[58] Field of Search ..... 114/61, 123, 274, 355, 114/356; 440/66, 67, 68

[56] References Cited

U.S. PATENT DOCUMENTS

| | | | |
|---|---|---|---|
| 2,950,699 | 8/1960 | Ogden et al. | 114/61 |
| 3,045,263 | 7/1962 | Blachly | 9/1 |
| 3,210,783 | 10/1965 | Petty | 9/1 |
| 3,289,226 | 12/1966 | Thompson | 9/1 |
| 3,996,871 | 12/1976 | Boismand | 114/61 |
| 4,348,977 | 9/1982 | Okajima | 114/61 |
| 4,478,166 | 10/1984 | Sorensen | 114/61 |
| 4,870,919 | 10/1989 | Allison | 114/61 |
| 4,907,520 | 3/1990 | Pipkorn | 114/61 |
| 4,993,340 | 2/1991 | Pepper | 114/61 |
| 5,041,032 | 8/1991 | Makihara et al. | 440/66 |

*Primary Examiner*—David M. Mitchell
*Assistant Examiner*—Stephen P. Avila
*Attorney, Agent, or Firm*—Michael, Best & Friedrich

[57] ABSTRACT

The invention discloses a pontoon boat adapted to be propelled by an outboard motor, the boat having a deck and pair of longitudinally extending parallel spaced apart pontoons depending from the deck and a means for mounting the outboard motor to the boat. The mounting means depends from the deck between the pontoons and comprises a pair of elongated substantially vertical spaced apart side walls having front and aft ends, the side walls becoming deeper and more spaced apart as they extend from their front ends to their aft ends, a substantially vertical and laterally extending transom positioned between the side walls at the aft ends thereof and a bottom portion, the bottom portion depending from the side walls and having a V-configuration in cross section and extending rearwardly of the side walls and the transom.

18 Claims, 2 Drawing Sheets 12
14
16
44
50
46
47
59
10
18
16

42
28
26
44
30
58
43
59
46
40

53
48
50
52
51
42
26
28
32
34
30
44
56
38
36
40
59

11
12
14
66
70
22
24
20
24
44
47
41
74
58
61
10
68
43
40
59
60
76
70

66
58
47
11
61
59
60
70
76

11
20
14
12
42
44
47
47
74
28
30
16
16
40
61
60
70
76

MOTOR POD FOR PONTOON BOAT

FIELD OF THE INVENTION

This patent relates to aluminum pontoon boats, especially those powered by outboard motors, and describes a new motor pod construction for mounting the outboard motor on the pontoon boat.

BACKGROUND OF THE INVENTION

Aluminum pontoon boats have become popular in the United States as they can inexpensively provide a recreational boat having a relatively stable open deck area. These boats are generally constructed of a pair of spaced apart longitudinal parallel pontoons depending from a flat deck. The pontoons can be either of cylindrical cross section or of a U-shaped cross section.

Generally, this type of boat is propelled by an outboard motor which is mounted on a center motor pod which depends from the deck between the pontoons near their aft ends. The invention of this patent is a new and novel motor pod which allows for more efficient operation of the outboard motor, less annoying spray, and better maneuverability of the boat.

Attention is directed to the following patents:

1. U.S. Pat. No. 2,950,699—PONTOON BOATS.
2. U.S. Pat. No. 3,045,263—RAFT STRUCTURE.
3. U.S. Pat. No. 3,210,783—WATER VEHICLE.
4. U.S. Pat. No. 3,289,226—PONTOON BOAT.
5. U.S. Pat. No. 4,993,340—BOAT STRUCTURE.

Attention is also directed to U.S. Pat. No. 4,657,513 which discloses a deflector plate, the motor pod shown in the 1992 Landau Manufacturing Company 1992 Aluminum Boats catalogue, and Lowe Industries drawing No. 797 entitled "Old Motor Pod".

SUMMARY OF THE INVENTION

The invention comprises a pontoon boat adapted to be propelled by an outboard motor, the boat having a deck and pair of longitudinally extending parallel spaced apart pontoons depending from the deck and a means for mounting the outboard motor to the boat. The mounting means depends from the deck between the pontoons and comprises a pair of elongated substantially vertical spaced apart side walls having front and aft ends, the side walls becoming deeper and more spaced apart as they extend from their front ends to their aft ends, a substantially vertical and laterally extending transom positioned between the side walls at the aft ends thereof and a bottom portion, the bottom portion depending from the side walls and having a V-configuration in cross section and extending rearwardly of the side walls and the transom.

In one embodiment, the mounting means further comprises a pair of splash rails extending outwardly from the side walls.

In another embodiment, the transom is constructed entirely of aluminum, being made of aluminum tubes welded together with an aluminum central plate.

In another embodiment, the outboard motor comprises a splash plate and the aft end of the bottom portion is positioned immediately in front of and below the spray plate of the outboard motor while the motor is in a normal running position.

The invention also comprises a pontoon boat comprising a deck, a pair of parallel longitudinal spaced apart pontoons depending from the deck and a means for mounting a marine propulsion unit to the boat, the mounting means depending from the deck between the pontoons and comprising a pair of elongated laterally spaced apart side walls and a bottom wall extending between the side walls, the bottom wall having a center portion and a pair of outer portions with the outer portions attached to the side walls and the center portion extending below the outer portions and having an aft portion extending rearwardly of said side walls. The bottom wall also becomes wider as it extends from fore to aft.

In certain embodiments, the bottom wall can have a V-shaped cross section, a semi-circular cross section or a parabolic cross section.

The invention also comprises a pod for mounting an outboard motor to a pontoon boat comprising a pair of elongated spaced apart side walls and a bottom wall with each of the side walls having a front portion and an aft portion with the front portions of the side walls being closer together than the aft portions of the side walls. The bottom wall depends from the side walls and has an aft portion extending rearwardly of the side walls and also a center portion and a pair of outer portions with the center portion positioned below the outer portions.

A principal feature of the invention is the provision of an improved means for mounting an outboard motor on a pontoon boat comprising an elongated motor pod. The pod enhances the performance of the boat by reducing the amount of spray caused by water hitting the lower unit of the outboard while the boat is under way. This is accomplished by deflecting the water around the elongated pod. The relative narrowness of the pod also allows water from the insides of each of the two pontoons to easily pass by the pod and motor to aid in the performance of the boat. The construction of the pod also allows for additional trim out of the outboard which enhances the performance of the boat. Moreover, by being constructed entirely of aluminum, the pod is light weight and will not rot.

Various features of the invention will be apparent from reference to the following description of a preferred embodiment, from the drawings and from the claims.

Figure 1:
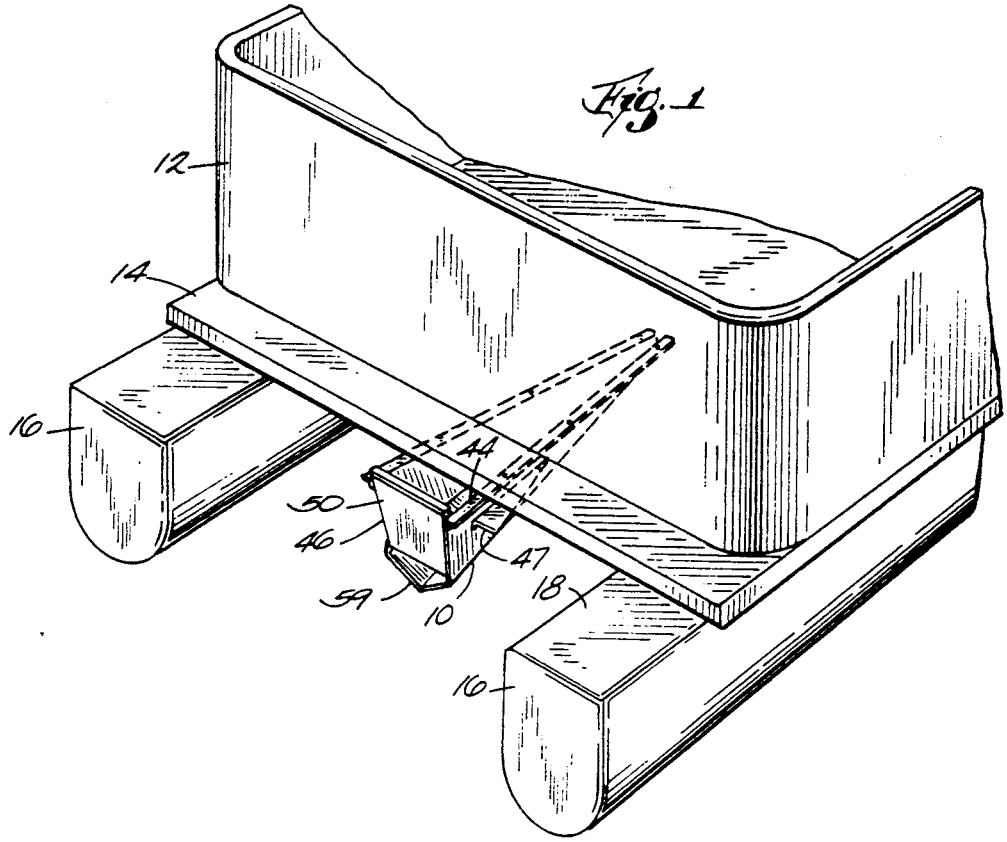
FIG. 1 is a rear perspective view of the aft end of a pontoon boat having a motor pod with the invention.

Before at least one embodiment of the invention is explained in detail, it is to be understood that the invention is not limited in its application to the details of construction and arrangements of the components set forth in the following description and illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Illustrated in the figures, the invention comprises a new and novel means for mounting a marine propulsion system motor pod 10 such as an outboard motor 11 onto a pontoon boat 12.

Figure 4:
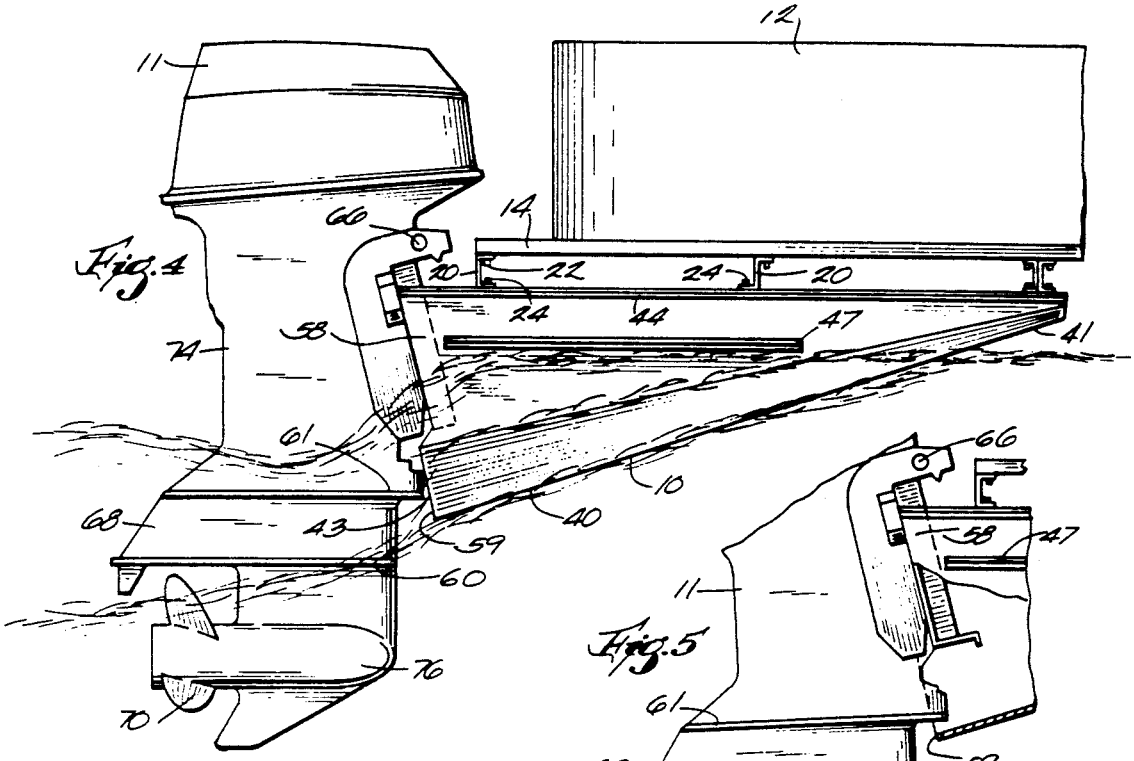
FIG. 4 is a side elevation view of the aft end of a pontoon with an outboard motor showing the water flow under and around the motor pod as if the associated boat were in motion.

Only the aft portion of a pontoon boat is shown in the drawings, especially FIGS. 1 and 4. However, construction of the pontoon boat is known in the art and comprises a deck 14 which is substantially rectangular and horizontally disposed. Upon the deck 14 are passenger seats and a helm station operatively connected to the outboard motor 11 for maneuvering the boat. Depending beneath the deck are a pair of parallel longitudinally extending spaced apart pontoons 16. The pontoons shown in the drawings have a U-shaped cross section and are enclosed by a flat top 18. However, the invention works equally well with cylindrical pontoons which are also common in the art. The pontoons and deck 14 are generally between 16 and 20 feet long (not shown). The front ends of the pontoons are tapered to increase their hydrodynamic efficiency. The interior of the pontoons can either be void or filled with a buoyant foam.

As can be seen in FIG. 1, in a preferred embodiment, the pontoons may extend rearwardly of the deck 14. However, it is known in the art to have the rearward extension of the deck 14 and the pontoons 16 terminate at the same location. This location may be either in front of or behind the most rearward point of the motor pod 10 without detracting from the benefits of the invention.

If the pod 10 is either at the aft end of the deck or in front of the aft end, a cut-out of the deck will be needed to accommodate the upward or clockwise (as seen from the right) tilting of the outboard motor 11. As can be seen in FIGS. 1 and 4, the transom 46 of the motor pod 10 in the embodiment extends rearwardly of the deck 14 to allow room for the mounting of the outboard motor 11 or other marine propulsion device used to propel the pontoon boat 12 through the water.

The two pontoons 16 are connected to the deck 14 by a series of cross braces 20 which can either be in the form of channel sections or a Z sections as shown in FIG. 4. The deck is supported on the top of the cross braces 20 and the pontoons 16 are attached to and depend from the bottoms of the cross braces by a plurality of bolts or rivets 22.

The motor pod 10 is also attached to the underside of at least a pair of the rearward most cross braces 20 at a point midway laterally between the two pontoons 16 by a series of bolts or rivets 24.

Figure 2:
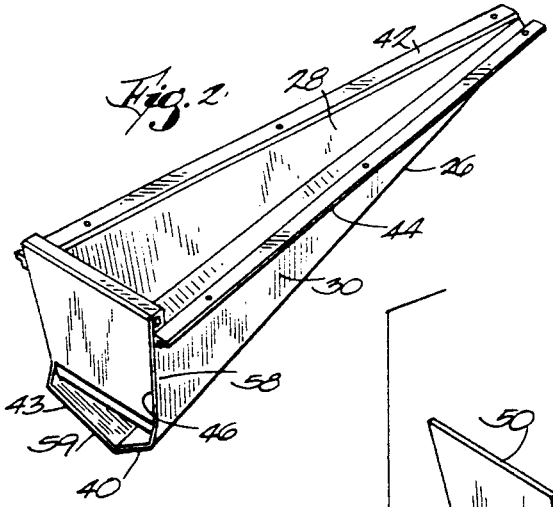
FIG. 2 is a rear perspective view of a motor pod showing the invention.
Figure 3:
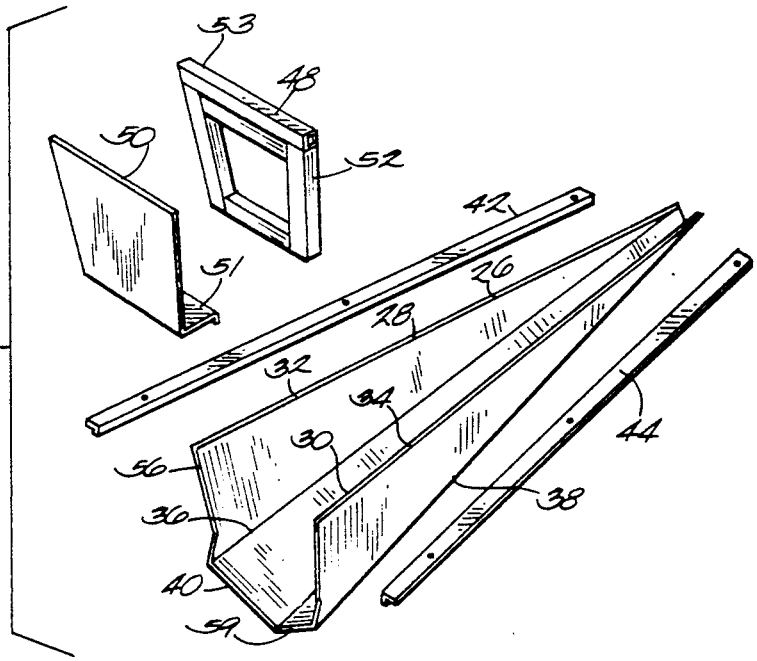
FIG. 3 is an exploded view of the motor pod shown in FIG. 2.

As illustrated in FIGS. 2 and 3, the motor pod 10 comprises an elongated main body section 26 which comprises a pair of elongated spaced apart side walls 28 and 30. Each of the side walls has an upper portion 32 and 34 and a lower portion 36 and 38. In a preferred embodiment, the side walls are substantially vertical, but they may be sloped at an angle without detracting from the spirit of the invention.

Figure 6:
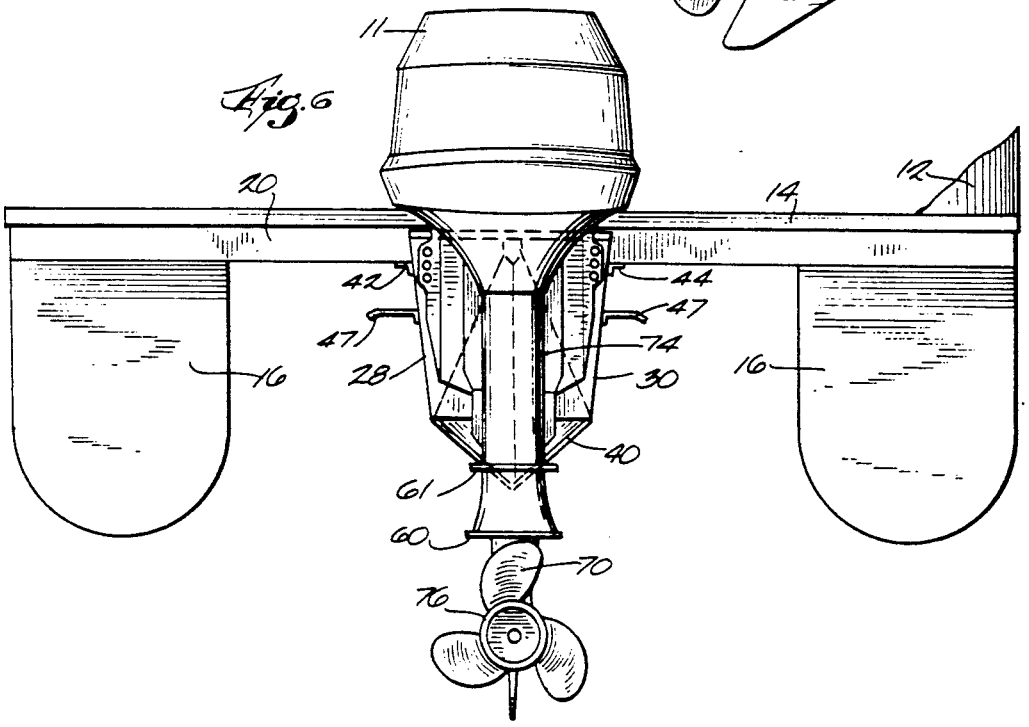
FIG. 6 is a rear elevational view of the pontoon boat motor pod and outboard motor.

Depending from the lower portions 36 and 38 of the side walls is a bottom wall or portion 40 as can best be seen in FIGS. 3 and 6. In a preferred embodiment the bottom wall 40 has a V-shaped cross section along its length. In other embodiments, the cross sectional shape of the bottom wall may be semi-circular or parabolic without detracting from the spirit of this invention. Moreover, the bottom wall 40 becomes wider as it extends from the front portion 41 of the motor pod 10 to the aft portion 43 as the side walls 28 and 30 diverge, but other geometries are contemplated by the invention.

Attached to the upper portions 32 and 34 of the side walls 28 and 30 are a pair of channels 42 and 44. One side of each channel is attached to the side walls by either welding or by means of a series of bolts or rivets. The other side of each of the channels 42 and 44 is attached to the bottom sides of at least a pair of cross members 20 by means of bolts or rivets 24 as described above. In addition, a pair of splash rails 47 extend outwardly from the side walls.

In one embodiment, the motor pod 10 also has a transom 46 which comprises a frame 48 and a rear sheet 50. In a preferred embodiment the frame is made by welding four aluminum box sections 52. The frame is generally in the shape of a polyhedron with the top and bottom sides parallel with the top side being longer than the bottom side. Along and attached to the top member is a parallel reinforcing member 53 to support the top portion of the rear sheet 50. The rear sheet encloses the area between the sides of the polyhedron and also has a forwardly extending bottom lip 51.

As illustrated in FIGS. 2 and 4, the transom is attached to the aft portions 56 and 58 of the side walls 28 and 30. The transom 46 is offset at a slight angle from the vertical as is common in the art. As can also be seen in FIGS. 2 and 4, the bottom wall 40 of the motor pod 10 extends rearwardly of the transom 46 and the side walls 28 and 30 terminates in an aft edge 59.

The outboard motor 11 comprises a powerhead 72 that drives a propeller 70 attached to a propeller shaft rotatably encased in a lower unit 68. The motor is also attached to the boat by means of the lower unit 68 which is bolted to the transom 46 of the motor pod 10. The upper portion 74 of the lower unit is wide in order to stably attach the motor to the boat. The lower portion 76 is more hydrodynamically streamlined. The motor is rotatable about a horizontal axis 66 near the top of the lower unit 68 so that the lower portion 76 of the lower unit 68 can rotate inwardly and outwardly with respect to the aft end 59 of the lower portion 40 of the motor pod 10. The outboard motor 11 also rotates about a vertical axis (not shown) for steering of the boat.

Above the propeller 70 is a pair of plates, including a anti-ventilation plate 60 and a splash plate 61. The anti-ventilation plate 60 is the lower of the two plates is and is narrow in front and wider in the back to protect the propeller from ventilating. The splash plate is approximately 4 inches above the anti-ventilation plate and keeps spray water from travelling upwardly on the lower unit of the motor. The splash plate is wider in the front of the lower unit and tapers into the lower unit in the rear.

As can also be seen in FIG. 6 with the bottom wall extending behind the side walls and transom, the aft edge 59 of the bottom wall 40 is positioned directly in front of and slightly below the splash plate 61 of the outboard motor and slightly above the anti-ventilation plate 60. As can also be seen in FIGS. 1 and 2, the bottom portion of the frame of the transom does not extend all the way down to the center portion of the bottom wall to allow any water that enters the pod to drain out the back and also allow room for the splash plate 61 to extend into the pod when the outboard motor 11 is fully trimmed in.

Figure 5:
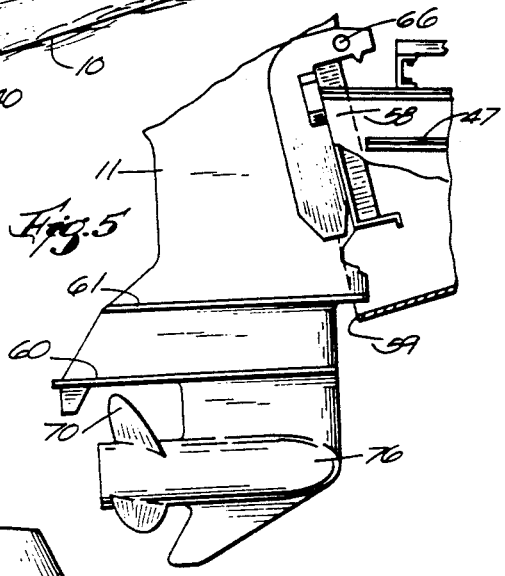
FIG. 5 is a detail of the relationship between the aft end of the motor pod and the outboard motor.

In one embodiment, the outboard motor 54 has hydraulic trim means (not shown) to pivot the outboard about the horizontal trim axis 66. As can be appreciated, this trimming means moves the lower unit of the outboard motor 68 which includes the splash plate 61 and propeller 70 with respect to the aft end of the motor pod 10, especially the aft end 59 of the lower wall 40. FIG. 4 shows the motor in the trimmed out position wherein the lower unit 68 is spaced from the aft end of the motor pod 59. FIG. 5 shows the motor in the trimmed in position wherein the splash plate 61 is much closer to the aft end of the pod. In either position, as depicted in FIG. 4, the shape of the pod allows water to flow around the pod and have clear access to the propeller so that the propeller will not cavitate nor ventilate but bite into clear water and propel the boat forwardly in an efficient manner. Moreover, the cooperation between the pod 10 and the lower unit and the splash plate 61 also reduces the amount of water impinging on the upper portion 74 of the lower unit 68 and thus reduces the spray caused by the lower unit.

In addition, the elongated shape of the motor pod acts to evenly direct the water over the lower unit and propeller of the outboard motor while the motor is being steered to turn the boat so that the motor does not see aerated water which would allow for slippage or cavitation.

In comparison with other motor pods in the prior art, the motor pod of this invention is relatively narrow, deep and long. For example, the pod is less than approximately 20" wide at the top of the rear side walls and less than 16½" wide at the bottom of the aft end of the side walls while being approximately 19" high at the transom and about 52" long. This prevents water which is disturbed from the pontoons that are spaced laterally from the pod from impinging on the upper portion 74 of the lower unit and creating splash. It also reduces the disturbance of the water seen by the propeller outboard motor, thus allowing for more efficient operation.

Various features and advantages of the invention are set forth in the following claims.

I claim:

1. A pontoon boat adapted to be propelled by an outboard motor, the boat having a deck and a pair of longitudinally extending parallel spaced apart pontoons depending from said deck and a means for mounting said outboard motor on the boat, said means also depending from said deck between said pontoons, said means comprising a pair of elongated substantially vertical spaced apart side walls, having front and aft ends, said side walls becoming deeper and more spaced apart as they extend from said front ends to said aft ends, a substantially vertically and laterally extending transom positioned between said side walls at the aft ends thereof, and a bottom portion, said bottom portion depending from said side walls, having a V-configuration in cross section, and extending rearwardly of said side walls and said transom.

2. The boat of claim 1 wherein said motor mounting means further comprises a pair of splash rails extending outwardly from said side walls.

3. The boat of claim 1 wherein said transom of said motor mounting means is entirely constructed of aluminum material.

4. The boat of claim 3 wherein said transom of said motor mounting means comprises a frame of aluminum box members and an aluminum exterior plate.

5. The boat of claim 1 wherein said motor mounting means side walls have top portions and bottom portions and the distance between said side wall top portions at their aft ends is less than 20" and the distance between said side wall bottom portions at their aft ends is less than 16½".

6. The boat of claim 1 wherein the outboard motor comprises a splash plate and said bottom portion has an aft end and said bottom portion aft end is positioned immediately in front of and below the spray plate of the outboard motor while the motor is in a normal running position.

7. The boat of claim 1 wherein the said motor mounting means side walls are approximately 56" in length.

8. A pontoon boat comprising a deck, a pair of parallel longitudinal spaced apart pontoons depending from said deck, and a means for mounting a marine propulsion unit to the boat, said mounting means depending from said deck between said pontoons and comprising a pair of elongated laterally spaced apart side walls having aft ends, a substantially vertically and laterally extending transom positioned between said aft ends of said side walls, and a bottom wall extending between said side walls, said bottom wall having a center portion and a pair of outer portions with said outer portions attached to said side walls and said center portion extending below said outer portions and having a sub portion extending rearwardly of said side walls and said transom, and bottom wall becoming wider as it extends from fore to aft.

9. The boat of claim 8 wherein the marine propulsion device comprises an outboard motor.

10. The boat of claim 9 wherein the outboard motor comprises a splash plate and said center portion of said bottom wall has an aft end and said aft end is positioned immediately in front of and below said splash plate when the outboard motor is in a normal running position.

11. The boat of claim 8 wherein said bottom wall of said mounting means has a V-shaped cross section.

12. The boat of claim 8 wherein said bottom wall of said mounting means has a semi-circular cross section.

13. The boat of claim 8 wherein said bottom wall of said mounting means has a parabolic cross section.

14. A pod for mounting an outboard motor to a pontoon boat comprising a pair of elongated spaced apart side walls and a bottom wall, each of said side walls having front and aft ends, said side walls becoming deeper and more spaced apart as they extend from said front ends to said aft ends, a substantially vertically and laterally extending transom positioned between said ends of said side walls, said bottom wall depending from said side walls and having an aft portion extending rearwardly of said side walls and said transom, said bottom wall also having a center portion and a pair of outer portions with said center portion positioned below said outer portions.

15. The pod of claim 14 wherein said transom is made entirely of aluminum material.

16. The pod of claim 14 wherein said aft portion of said center portion of said bottom wall extends beneath said transom.

17. The pod of claim 14 also comprising a means for connecting said pod to said pontoon boat.

18. The pod of claim 14 also having splash rails extending outwardly from said side walls.

* * * * *